US005217040A

United States Patent [19]

Hochstrasser

[11] Patent Number: 5,217,040

[45] Date of Patent: Jun. 8, 1993

[54] SAFEGUARD FOR A SANITARY FITTING

[75] Inventor: Ferdinand Hochstrasser, Auenstein, Switzerland

[73] Assignee: KWC AG, Unterkulm, Switzerland

[21] Appl. No.: 667,597

[22] Filed: Mar. 4, 1991

[30] Foreign Application Priority Data

Mar. 2, 1990 [CH] Switzerland ..... 00696/90

[51] Int. Cl.[5] ..... E03C 1/10

[52] U.S. Cl. ..... 137/218; 137/801

[58] Field of Search ..... 137/218, 801

[56] References Cited

U.S. PATENT DOCUMENTS

| | | | |
|---|---|---|---|
| 2,270,737 | 1/1942 | Langdon | 137/218 |
| 2,382,427 | 8/1945 | Langdon | 137/218 |
| 2,675,823 | 4/1954 | Langdon | 137/218 |
| 3,171,423 | 3/1965 | Dillon . | |
| 3,636,968 | 1/1972 | Tine . | |
| 3,818,929 | 6/1974 | Braukmann | 137/218 |
| 3,862,640 | 1/1975 | Hechler | 137/218 X |
| 4,013,088 | 3/1977 | Gocke et al. | 137/218 X |
| 4,013,089 | 3/1977 | Braukmann | 137/218 |
| 4,726,390 | 2/1988 | Franklin . | |
| 4,977,920 | 12/1990 | Oberdorfer | 137/218 |

FOREIGN PATENT DOCUMENTS

| | | |
|---|---|---|
| 45345/89 | 5/1990 | Australia . |
| 206227 | 1/1909 | Fed. Rep. of Germany . |
| 1144209 | 2/1963 | Fed. Rep. of Germany . |
| 8813390 | 12/1988 | Fed. Rep. of Germany . |
| 3839650 | 2/1990 | Fed. Rep. of Germany . |
| 1447303 | 8/1976 | United Kingdom . |

*Primary Examiner*—Gerald A. Michalsky

*Attorney, Agent, or Firm*—Oblon, Spivak, McClelland, Maier & Neustadt

[57] ABSTRACT

A first automatic valve of a safeguard is connected in the flow path of a sanitary fitting. The diaphragm, acting as the valve body of a second valve, interacts with the valve seat and the first valve is arranged on said diaphragm. Under normal operating conditions, the second valve is closed and the first valve is opened. Under conditions allowing backflow counter to the direction of the arrow S, the first valve closes automatically, by which action the diaphragm is deformed counter to the direction of the arrow S due to the suction on the input side, which results in the second valve being inevitably opened. By this construction, water is prevented from flowing back into the feedline and the outlet is connected to the ambient air through the opened second valve and the aeration path.

7 Claims, 7 Drawing Sheets

SAFEGUARD FOR A SANITARY FITTING

BACKGROUND OF THE INVENTION

1. Field of the Invention

The present invention relates to a safeguard for a sanitary fitting for preventing the backflow of water into a feedline.

2. Discussion of the Background

Sanitary fittings are known, in which the quality of the feed water can be endangered upon re-suction of impure water into the feedline. These include, in particular, washbasin and sink fittings including pull-out hose shower bath tap units having a hose shower. It can occur in the case of fittings of this type that the shower is lying in a basin or in a bath when, for example, the feedline breaks. If the fitting is open at that moment, the water in the basin or the bath can be completely sucked out via the shower due to the negative pressure which is built up in the feedline due to the water flowing off. Fittings of this type must have safeguards, by means of which the re-suction of impure water into the feedline is prevented.

A safeguard of this type is known from German Offenlegungsschrift 3,805,462. This fitting has a shutoff valve which is connected in the flow path between the feedline and the outlet of the fitting. Branching off from the flow path, as seen in the flow direction of the water, after the shutoff valve is an aeration path, in which the two valves of the safeguard are connected. These valves are constructed as sensitive check valves which, under normal operating conditions, are in a closed position. Under conditions allowing backflow, the two valves open automatically and thus aerate the outlet and the feedline in order to prevent the backflow of the water. It is possible under normal operating conditions, in particular in the case of rapid closure of the shutoff valve, for a negative pressure to be built up briefly in the flow path following the shutoff valve, by which means valves of the safeguard can be caused to open, which can lead to the fact that a droplet can emerge through the valves. In order to prevent this, the German Offenlegungsschrift mentioned teaches that the two valves should be arranged successively in such a wa that the negative pressure in the case of a rapid interruption of the water-drawing process only affects the first valve situated nearer to the flow path. The result of the delay between the two valves is that, under these operating conditions, the second valve does not open, and thus a water droplet emerging through the first valve is caught in the region between the two valves. In the case of a negative pressure lasting longer, such as occurs under conditions allowing backflow, both valves of the safeguard open in order to aerate the outlet and to prevent backflow of water into the feedline. It is disadvantageous in this known safeguard that the two valves have to be coordinated with one another extremely precisely and that they cannot reliably prevent of the backflow of water into the feedline since they do not interrupt the flow path of the fitting for the water.

Furthermore, a so-called "combined safeguard" is known from DIN 1988, Part 4, which consists of a backflow preventer and a pipe aerator connected downstream from the latter as seen in the flow direction. Under conditions allowing backflow, the backflow preventer, constructed as a check valve, closes off the flow path, whereas the pipe aerator connects the outlet to the ambient air.

SUMMARY OF THE INVENTION

Starting from this prior art, an object of the present invention is to provide a safeguard for a sanitary fitting which reliably prevents backflow of water into the feedline and the emergence of water through the aeration path.

This object is achieved by the features of the defining part of the claims of the present invention.

The two valves of the safeguard according to the invention are connected in the flow or aeration path of the fitting in the same manner as the backflow preventer and pipe aerator in accordance with the combined safeguard according to DIN 1988, Part 4. According to the present invention, the first valve connected in the flow path is constructed so as to be automatic and capable of movement between an operating position and a backflow position. Under normal operating conditions, the first valve is in the operating position and, under conditions allowing backflow, is moved automatically into a backflow position due to the pressure difference on the two sides of the valve. Since the valve body of the second valve also executes the movement of the first valve, the second valve is inevitably closed when the first valve is in the operating position, while the second valve is inevitably opened when the valve moves into the backflow position. It is ensured by this means that, under conditions allowing backflow, the flow path is shut off by the first valve and the outlet is inevitably aerated at the same time. Under normal operating conditions, the second valve is inevitably closed, which prevents the emergence of water even during rapid closure of the shutoff valve.

In an extremely simple safeguard in accordance with the present invention, the first valve itself is provided in a stationary manner, in which case, however, for inevitable actuation of the second valve, its valve body also executes movement of the valve body of the first valve.

BRIEF DESCRIPTION OF THE DRAWINGS

The present invention is now described in greater detail with reference to the exemplary embodiments illustrated in the drawings, in which, purely diagrammatically.

DESCRIPTION OF THE PREFERRED EMBODIMENTS

Figure 1:
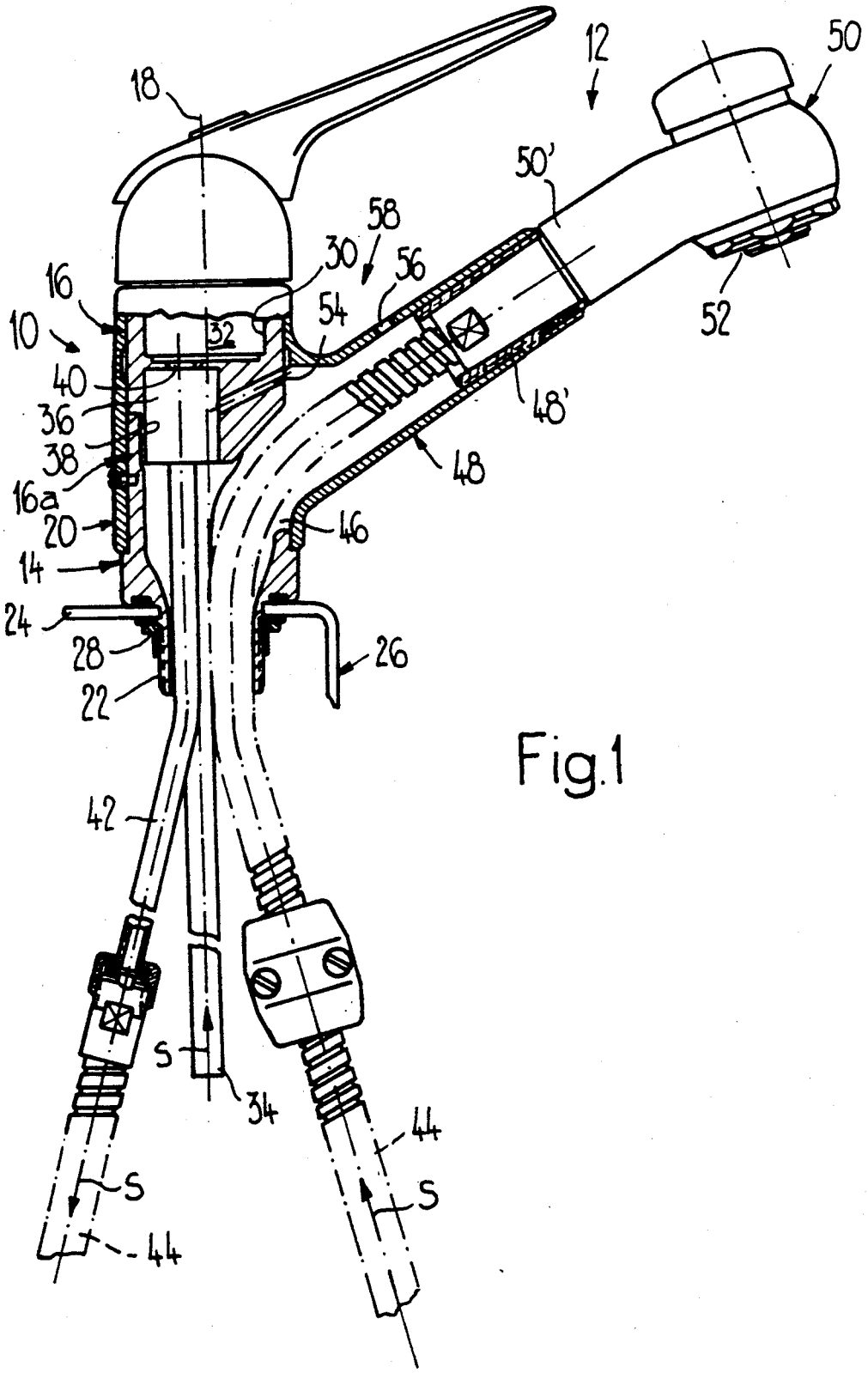
FIG. 1 shows, partially in section, a sink fitting having a pull-out hose shower in accordance with the present invention.

The sanitary fitting shown in FIG. 1 has a fitting housing 10 and a shower hose 12. The fitting housing 10 consists essentially of three parts, a lower and an upper housing part 14 and 16, respectively, these forming a fixed housing part 16*a*, and a jacket element 20 which is mounted on said housing part so as to be swivelable about an axis 18 extending essentially in the vertical direction. The lower housing part 14 is essentially of sleeve-shaped construction, penetrates with an attachment nozzle 22 an approximately horizontally extending edge 24 of a sink 26, and is fastened to the sink 26 by means of a nut 28 screwed onto the attachment nozzle 22.

The upper housing part 16 is seated on the lower housing part 14 and is attached to the latter. The essentially cylindrical fixed housing part 16*a*, formed by the lower and upper housing parts 14, 16, is surrounded by the jacket element 20 which is mounted on said fixed housing part so as to be swivelable about the axis 18.

The upper housing part 16 has a cylindrical recess which is open toward the top and has the form of a blind hole, in which recess a control cartridge 32, indicated only diagrammatically, is inserted. The control cartridge 32 is a single-lever mixing valve, such as is generally known and described in detail, for example, in Swiss Patent Specifications 651,119 or 654,088. On the inlet side, the control cartridge 32 is connected in each case to a feedline 34 for cold and hot water, only one of the feedlines 34 being shown in the figure. The feedlines 34 are guided from below through the attachment nozzle 22 and the lower housing part 14 and open out into a bore hole (not shown) in the upper housing part 16, which bore hole connects the feedlines 34 to the control cartridge 32.

Connected downstream from the control cartridge 32 is a safeguard 36, indicated only diagrammatically in this figure, which is inserted in an additional recess 38 in the upper housing part 16, which recess is open toward the lower housing part 14 and has the form of a blind hole. Provided between the recess 30 and the additional recess 38 is a passage aperture 40 which connects the control cartridge 32 in terms of flow to the safeguard 36. Guided away from the safeguard 36 in the direction of the axis 18 toward the bottom is a pipe 42 which is guided through the attachment nozzle 22 below the sink 26. This end of the pipe 42 is connected to a flexible hose 44 of the shower hose 12, which hose is guided with the other end region through the attachment nozzle 22 again, forming a supply loop below the sink 26. The lower housing part 14 has an aperture 46 extending approximately in a radial direction, passing through which aperture the end region of the hose 44 is guided into a nozzle 48 which is molded onto the jacket element 20 and projects obliquely upward from the latter. The hose 44 opens out into a shower 50, the handle 50' of which is inserted with the hose-side end region in a guide bush 48' arranged in the nozzle 48 in a manner such that it can be pulled out again. The outlet of the shower hose 12 is denoted as 52. The aperture 46 for the hose 44 is of such a size in the circumferential direction of the lower housing part 14 that swiveling of the jacket element 20 is possible without any difficulties.

Provided in the upper housing part 16 is an aeration channel 54 which extends from further recess 38 to the nozzle 48. Provided on the upper side of the nozzle 48 is a hole 56 which, together with the nozzle 48 and the aeration channel 54, connects the safeguard 36 to the ambient air, forming an aeration path 58. A further possible development of the aeration path 58 is described in Swiss Patent Application 04 481/89-9 corresponding to U.S. patent application Ser. No. 07/627,195, now U.S. Pat. No. 5,090,062.

Situated between the feedline 34 and the outlet 52 is the flow path 60 for the water, in which flow path the control cartridge 32 and, mounted downstream from the latter as seen in the flow direction S of the water, the safeguard 36 are connected and which has the passage aperture 40, the pipe 42, the hose 44 and the shower 50.

Figure 2:
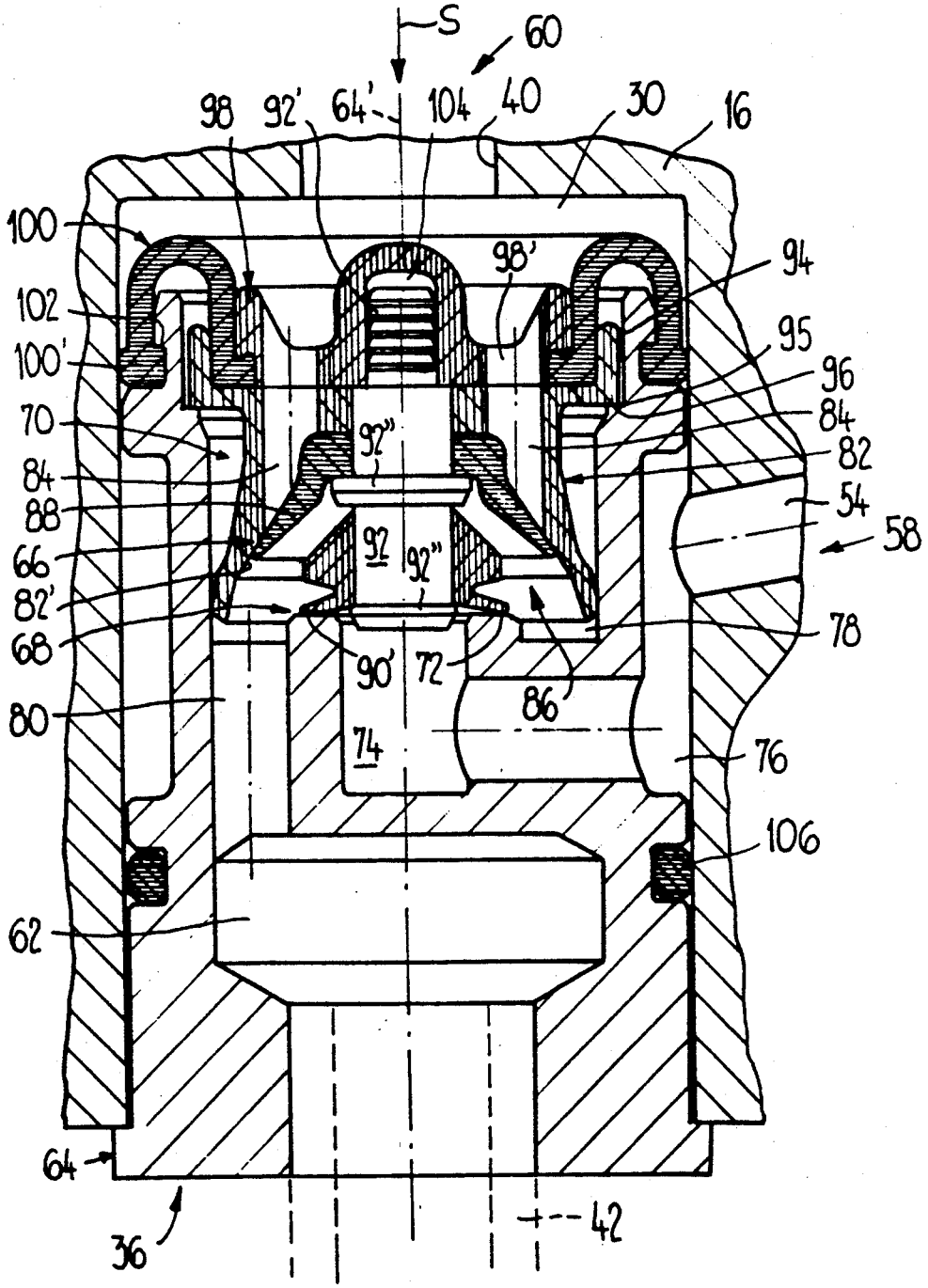
FIG. 2 shows a first embodiment of a safeguard for the fitting in accordance with FIG. 1 under normal operating conditions and without flow of water.

FIG. 2 shows an embodiment of the safeguard 36 which is inserted from below in the additional recess 38 of the upper housing part 16. Advantageously the safeguard 36 is attached to the upper housing part 16 in such a way that it can be dismantled, for example for servicing, without any problems. Thus it is possible for the safeguard 36 to be constructed such that it can be screwed into the upper housing part 16 or attached in a known manner by means of screws, pins or spring rings. The water flows from the control cartridge 32 through the passage aperture 40 in the flow direction S through the safeguard 36 to the pipe 42, indicated in dashed lines, which is guided from below into an outlet aperture 62 of a housing 64 of the safeguard 36. The aeration channel 54 is guided away from the central region of the additional recess 38 obliquely upward through the upper housing part 16 to the nozzle 48 (see FIG. 1).

The safeguard 36 has two valves 66, 68, the first valve 66 being connected in the flow path 60 leading through the safeguard 36 and the second valve 68 being connected in the aeration path 58 connecting the flow path 60 to the ambient air. The second valve 68 is provided at the entry of the aeration path 58 into the flow path 60 and is mounted as seen in the flow direction S, downstream of the first valve 66.

The housing 64 has an essentially cylindrical housing recess 70 which is open toward the passage aperture 40 and has the form of a blind hole, in the base region of which there is constructed an annular valve seat 72 for the second valve 68. The valve seat 72 borders and bounds an aeration passage 74 which extends away from the housing recess 70 downward firstly in the direction of the axis 64' and then in the radial direction to a circumferential groove 76 provided on the housing 64, which circumferential groove is connected in terms of flow to the aeration channel 54. Extending around the valve seat 72 there is a groove-shaped indentation 78, from which bore holes 80 begin extending in the direction of the axis 64', which bore holes connect the housing recess 70 to the outlet opening 62.

In the housing recess 70, a piston-shaped valve seat element 82 is guided so as to be displaceable in the direction of the axis 64'. It has a plurality of flow apertures 84 arranged in annular fashion around the axis 64' and extending parallel to said axis, which flow apertures open out at the bottom into an indentation 86 in the valve seat element 82, said indentation having an upwardly directed bell shape. Provided in this indentation 86 are both the valve body 88 of the first valve 66 and the valve body 90 of the second valve 68.

The valve body 88 of the first valve 66 has a bell-shaped form. It consists of rubber-elastic material, covers the flow apertures 84 and bears with its lower end region against the inside wall 82' of the valve seat element 82, which inside wall thus forms the valve seat of the first valve 88. The valve body 88 is attached to the valve seat element 82 by means of a shaft 92 penetrating said valve body and the valve body 90 of the second valve 68 is seated o the free end region of the shaft 92 projecting in the direction toward the bottom. Said valve body has a lip 90, interacting with the annular valve seat 72.

Mounted in the upper end region on the valve seat element 82 is a step-shaped peripheral widening 94 which, as the stop 95 acting in the direction S, interacts with a corresponding stepwise taper 96 in the housing recess 70. This stop 95 defines the operating position of the valve seat element 82 shown in FIG. 2 and thus the first valve 66.

Inserted in the upper region of the valve seat element 82 is a perforated disk 98, the holes 98' of which are in alignment with the flow apertures 84 in the valve seat element 82. Held at the inner end between the valve seat element 8 and the perforated disk 98 is an annular sealing member 100 shaped like a rolled diaphragm made of rubber-elastic material which surrounds the widening 94 and the upper end region of the housing 64 in a U-shape counter to the flow direction S and is held braced between the housing 64 and the upper housing part 16 by means of a protrusion 100' engaging in a circumferential groove 102 in the housing 64.

The perforated disk 98 is attached to the valve seat element 82 by means of the shaft 92. The shaft 92 penetrates the valve seat element 82 and engages with its upper end region 92, of a rib-type construction in a blind hole 104 in the perforated disk 98. The ribs of the upper end region 92' of the shaft 92 are of lamella-type construction, with the result being that they prevent the shaft 92 from being released from the blind hole 104. The two valve bodies 88, 90 are held by means of circumferential holding ribs 92'', of the shaft 92, the valve body 88 of the first valve 66 being arranged between the valve seat element 82 and one holding rib 92'' and the valve body 90 of the second valve 6 being arranged between said holding rib and the other holding rib 92''.

The valve seat element 82 is constructed so as to conically widen, as seen in the flow direction S, between the widening 94 and the lower end region, with the result being that the valve seat element 82 is guided on the housing 64 in a sliding manner only at its lower end region. This reduces the friction between the housing 64 and the valve seat element 82. Additionally, this prevents scaling which could impede or prevent displacement of the valve seat element 82 counter to the flow direction from the operating position shown in the figure into a backflow position a shown in FIG. 4.

Provided below the circumferential groove 76 is an O-ring 106 which bears against the upper housing part 16 and is arranged in a corresponding groove in the housing 64 of the safeguard 36. Thus the circumferential groove 76 is sealed off at the top by the protrusion 100' of the sealing member 100 and at the bottom by this O-ring 106.

Figure 3:
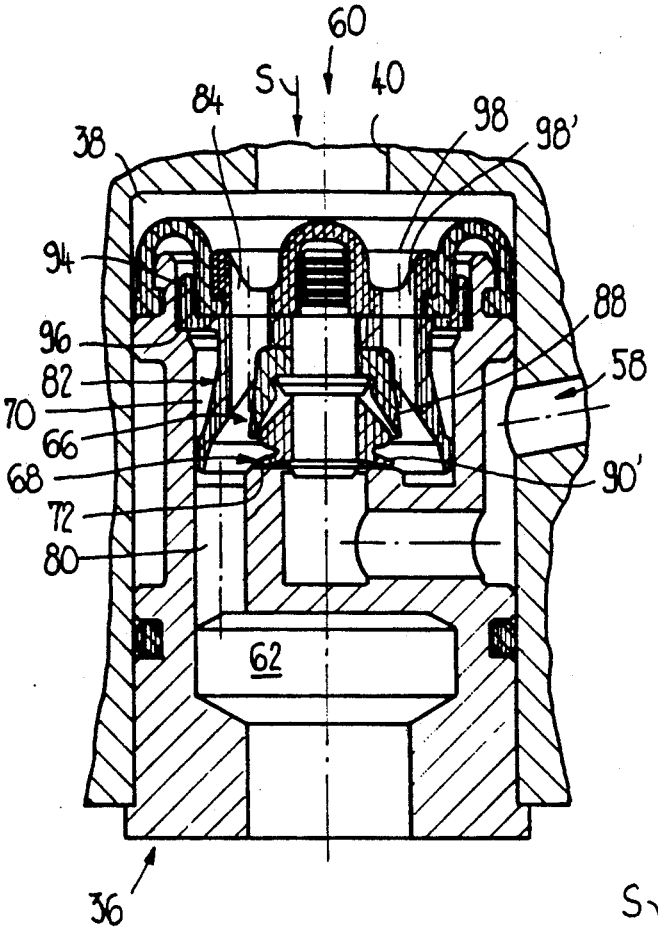
FIG. 3 shows the embodiment according to FIG. 2 also under normal operating conditions but during a water-drawing process.
Figure 4:
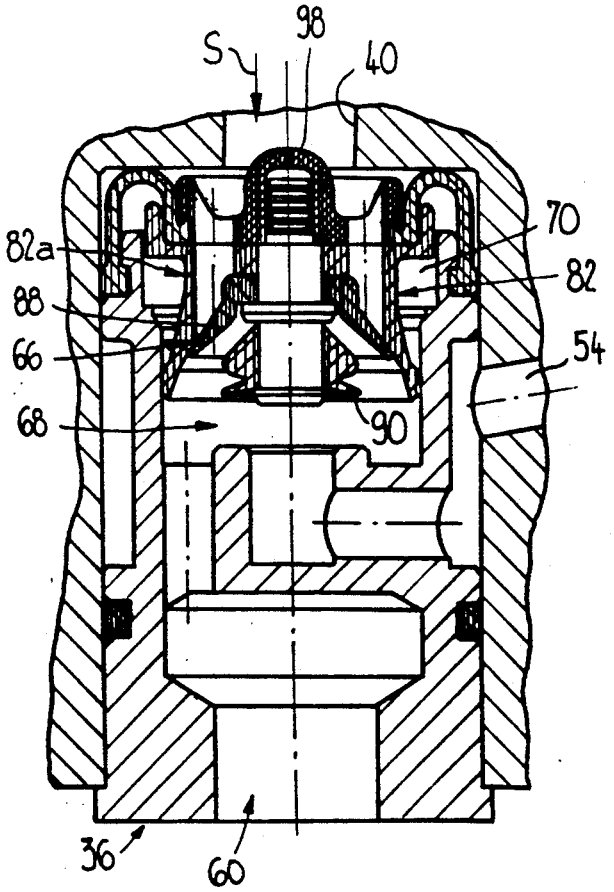
FIG. 4 shows the embodiment according to FIG. 2 under conditions allowing backflow.

The mode of functioning of the safeguard 36 shown in FIG. 2 is now described with the aid of FIGS. 2 to 4. In FIGS. 3 and 4 respectively, the safeguard 36 of FIG. 2 is shown during a normal water-drawing process (FIG. 3) and under conditions allowing backflow (FIG. 4). The reference numerals in FIGS. 3 and 4 are specified only insofar as this is necessary for understanding the figures.

Under normal operating conditions, the first valve 66 is in the operating position shown in FIGS. 2 and 3, in which the valve seat element 82 bears with the widening 94 against the taper 96 of the housing recess 70. In this case, the lip 90, interacting with the valve seat 72 holds the second valve 68 closed, with the result being that the flow path 60 is cut off from the aeration path 58. If the control cartridge 32 does not allow water to flow from the feedlines 34 through the passage aperture 40 and from the further parts of the flow path 60 to the outlet 52 (FIG. 1), the first valve 66 is closed as a result of the prestress of the valve body 88, as is shown in FIG. 2. If the control cartridge 32 is now opened, water flows in the flow direction S along the flow path 60 through the passage aperture 40 into the additional recess 38. At that point, the water is fed through the holes 98' of the perforated disk 98 and the flow apertures 84 in the valve seat element 82 to the first valve 66 which opens automatically due to the elastic valve body 88 bending downward, as is shown in FIG. 3. The water then flows through the bore holes 8 to the outlet aperture 62 where it is conducted to the pipe 42 and through the hose 44 to the outlet 52 of the shower 50. It should be noted that the second valve 68 is always closed and, when the water is flowing, the lip 90' is pressed against the valve seat 72, which prevents the emergence of water in the direction towards the aeration path 58. Additionally, the valve seat element 82 is held bearing against the stop 95 by the water flowing in the flow direction S. If the control cartridge 32 is now closed again, the first valve 66 also closes automatically since the valve body 88 moves back into the position shown in FIG. 2 again, in which it bears against the inside wall 82' of the valve seat element 82. Even in the case of the water flow being interrupted very rapidly by closure of the control cartridges 32, the lip 90' of the second valve 68 cannot be lifted from the corresponding valve seat 72 since the valve seat element 82 is pulled in the flow direction S by the rapid deceleration of the water column following the control cartridge 32 in the flow path 60, which prevents the second valve 68 from opening. Consequently, under normal operating conditions no water can flow out through the second valve 68 since the latter is inevitably held in its closed position.

If the extremely rare case now occurs that a negative pressure is built up in the feedline 34, for example due to a pipe rupture in the feed network with the control cartridge 32 opened, the water attempts to flow back counter to the flow direction S. In this case, however, the valve body 88 closes the first valve 66 immediately, with the result being that no water can be drawn back from the outlet 52 through the flow path 60 into the feedline 34. Consequently, negative pressure is maintained on the side of the first valve 66 facing the feedline 34, whereas, on the side facing the outlet 52, ambient pressure prevails. The consequence of this is that the first valve 66, together with the valve body 90 of the second valve 68, is displaced into the backflow position **82*a* shown in FIG. 4. In this backflow position 82*a*, the sealing member 100 shaped like a rolled diaphragm is in contact with the upper housing part 16, (at the base of the recess 38). By this means, the second valve 68 is inevitably opened, with the result being that the part of the flow path 60 which is on the outlet side in relation to the first valve 66 is connected to the aeration channel 54. Consequently, under conditions allowing backflow the outlet 52** is inevitably aerated.

The first valve 66 now remains in the backflow position 82*a* until water again impacts on the valve seat element 82 or the perforated disk 98 in the flow direction S. Due to the impacting water, the valve seat element 82 slides readily in the housing recess 70 and thus the first valve 66 is pushed back into the operating position shown in FIGS. 2 and 3, by which means the second valve 68 is inevitably closed. The water can then again flow to the outlet 52 by automatic opening of the first valve 66.

Figure 5:
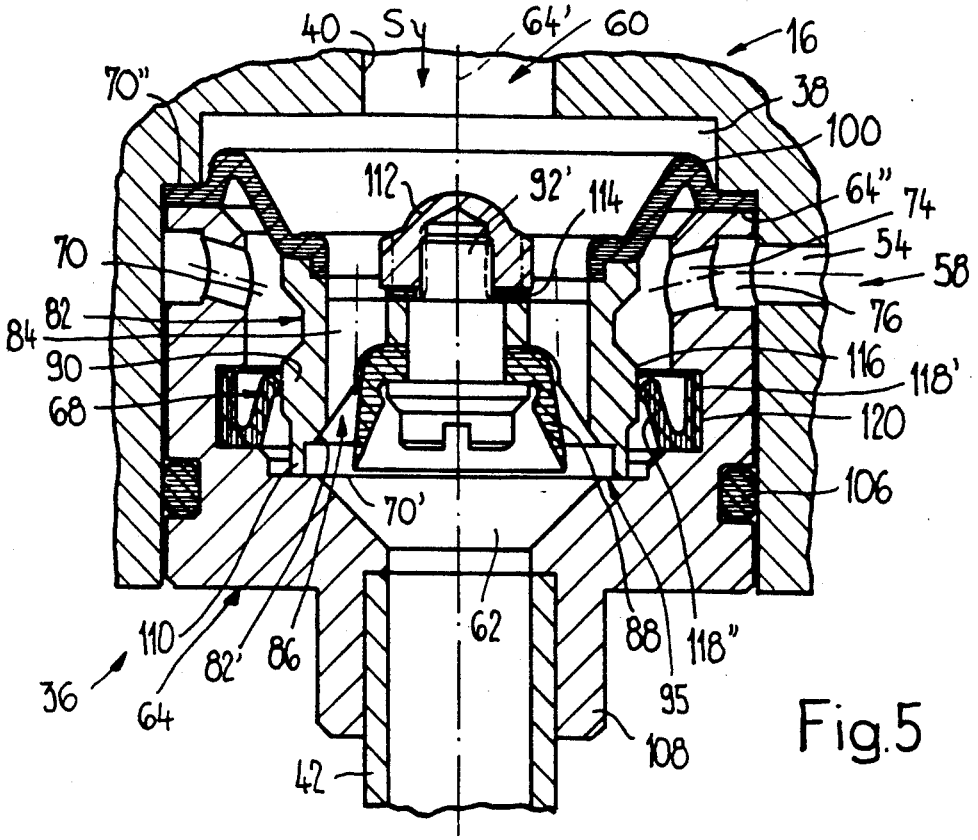
FIG. 5 shows a second embodiment of the safeguard under normal operating conditions during a water-drawing process.
Figure 6:
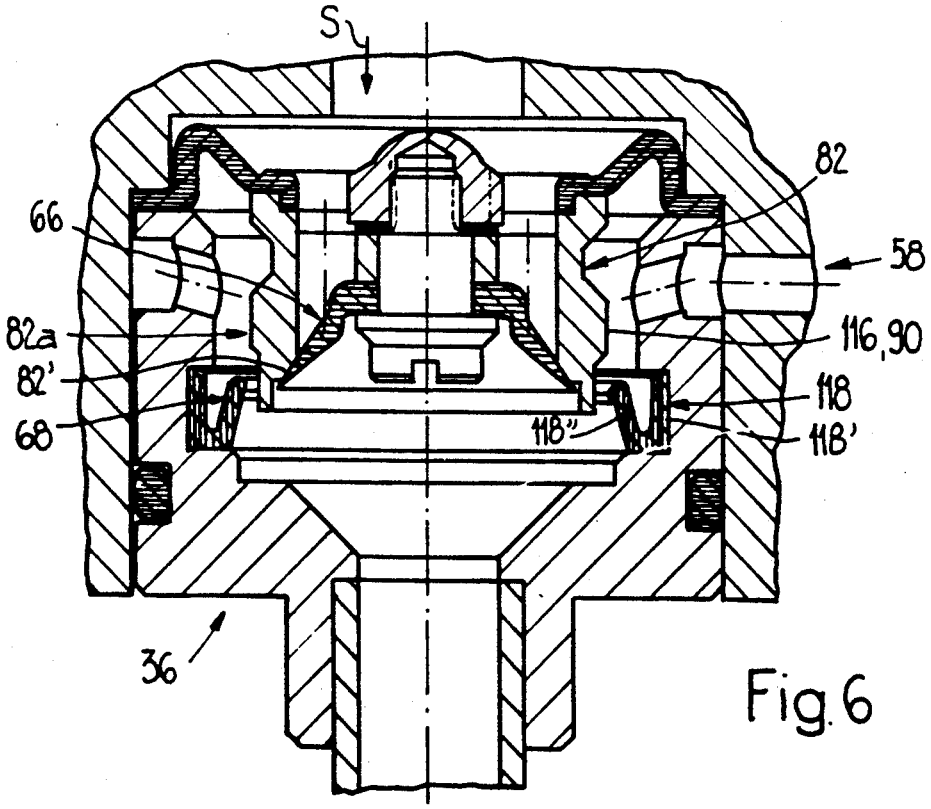
FIG. 6 shows the embodiment of FIG. 5 under conditions allowing backflow.

The development of the safeguard 36 shown in FIGS. 5 and 6 is similar to the safeguard shown in FIGS. 2 to 4, the valve seat element 82 itself, however, being constructed as valve body 90 of the second valve 68. Parts with the same function are denoted by the same reference numerals as in FIGS. 2 to 4.

In this embodiment of the safeguard 36, too, the essentially cylindrical housing 64 is inserted from below in the additional recess 38 of the upper housing part 16 and fastened in a known manner. The water coming from the control cartridge 32 (FIG. 1) flows in the flow direction S into the additional recess 38, flows through the safeguard 36 and is fed to the hose 44 by means of the pipe 42 leading away from the safeguard 36 and to the outlet 52 of the shower 50. Provided in the housing 64 is an essentially cylindrical housing recess 70 which has the form of a blind hole and which opens out in its base region into a conically tapering outlet aperture 62 which is communicated to the pipe 42 which is inserted with this end region into a connection nozzle 108 of the housing 64. The axis of the housing 64 and of the housing recess 70 is denoted as 64, and is indicated by dot-dashed lines. Provided in the housing recess 70 is the essentially cylindrical valve seat element 82 which, in the operating position shown in FIG. 5, is in contact with a lug 110 projecting downward in the axial direction at the base 70' of the housing recess 70, forming the stop 95. Extending through the valve seat element 82 along a circle about the axis 64' and parallel thereto are flow apertures 84 which connect the passage aperture 40, as seen in the flow direction S, to the bell-shaped indentation 86 in the valve seat element 82 on the outlet side. Provided in this indentation 86 is the valve body 88 of the first valve 66, which valve body interacts with the valve seat formed in the region of the inside wall 82' following the flow apertures 84. The valve body 88 includes a rubber-elastic material, is of bell-shaped construction and is in contact with the inside wall 82' when the water does not flow in the flow direction S, as is shown in FIG. 6. The valve body 88 is seated on the shaft 92 which is constructed as a shaft screw, penetrates the valve seat element 82 in the region between the flow apertures 84 in the direction of the axis 64' and is screwed into a cap-shaped nut 112 by its end region 92' remote from its head or the valve body 88. Provided between the nut 112 and the valve seat element 82 is a washer 114 made of plastic. In the case of water flowing in the flow direction S, the valve body 88 made of rubber-elastic material is deformed into the shape shown in FIG. 5 in order to conduct the inflowing water to the outlet aperture 62 and to the pipe 42.

As seen in the flow direction S, an annular sealing member 100 shaped like a rolled diaphragm is attached, for example, by means of vulcanizing or bonding on, to the valve seat element 82 where it begins, which sealing member is clamped along its outer circumferential region between this end 64'' of the housing 64 and a step 70'' of the housing recess 70. The sealing member 100 prevents the flow of water between the valve seat element 82 and the housing 64.

As seen in the radial direction, the valve seat element 82 is spaced away from the inside wall of the housing 64 bounding the housing recess 70 and has a circumferential sealing protrusion 116 which interacts with a cross-sectionally U-shaped annular seal 118 which forms the valve seat 72 for the second valve 68. Consequently the valve seat element 82 is also the valve body of the second valve 68. The sealing ring 118 is held in the housing 64 by its outer flank 118' in a relief 120 adjacent to the base 70' of the housing recess 70, the other flank 118'' being constructed as a resilient sealing lip and bearing against the sealing protrusion 116 on the circumferential side when the valve seat element 82 is in the operating position. The region of the housing recess 70, which is bounded, as seen in the radial direction, by the housing 64 and the valve seat element 82 and, in the axial direction, by the sealing member 100 and the second valve 68, is connected via a plurality of aeration passages 74, extending approximately radially through the housing 64, to a circumferential groove 76 which is provided on the housing 64 and, through the aeration channel 54, is in connection with the ambient air (cf. FIG. 1). Provided below the circumferential groove 76 is an O-ring 106 which is led into a corresponding groove in the housing 64 and bears against the upper housing part 16 (in the region of the additional recess 38). This O-ring 106 and the circumferential region of the sealing member 100 seal off the circumferential groove 76.

The safeguard 36 illustrated in FIG. 6 corresponds exactly to that in accordance with FIG. 5, but in this case the first valve 66 together with the valve seat element 82 is in the backflow position 82*a*. Since all the parts of FIG. 6 are identical to the parts of FIG. 5, the reference numerals are only shown in FIG. 6 insofar as is necessary for understanding the figure. If the first valve 66 is in the backflow position 82*a*, the sealing protrusion 116 is remote from the annular seal 118 due to the displacement of the valve seat element 82 counter to the flow direction S, by which means the second valve 68 is inevitably opened and the outlet 52 is connected with the ambient air through the aeration path 58, the opened second valve 68 and the part of the flow path 60 of the water following the first valve 66, as seen in flow direction S.

The safeguard 36 shown in FIGS. 5 and 6 operates as follows: under normal operating conditions, the first valve 66 together with the valve seat element 82 is in the operating position shown in FIG. 5. In this case, the valve seat element 82 is supported on the base 70' of the housing recess 70 via the lug 110 counter to the flow of the water fed in flow direction S. If the water flow is interrupted by the control cartridge 32, the first valve 66 is closed by the valve body 88 bearing against the inside wall 82', as shown in FIG. 6. If, in contrast, the water flow is released by the control cartridge 32, the valve body 88 of the first valve 66 is deformed into the shape shown in FIG. 5, by which mean the flow from the feedline 34 to the outlet 52 is released in the direction of the arrow S along the flow path 60. If the water flow is interrupted by closure of the control cartridge 32, the first valve 66 closes by automatically bearing the valve body 88 against the inside wall 82' of the indentation 86 in the valve seat element 82. Even in the case of very rapid closure of the control cartridge 32, the second valve 68 cannot open since, in this case, the valve seat element 82 is pulled in the flow direction S against the stop 95. Consequently, no water can flow out into the aeration path 58 through the second valve 68' (FIG. 5).

However, if conditions allowing backflow occur, this being only the case when the control cartridge 32 is opened a is described above, the first valve 66 closes automatically and interrupts the flow connection between the outlet 52 and the feedline 34. As a result of the pressure conditions acting on the valve seat element 82 on both sides of the first valve 66, the valve seat element 82 together with the second valve 68 is displaced into the backflow position 82*a* counter to the direction of the arrow S, as is shown in FIG. 6. The valve body 90 of the second valve 68 formed by the sealing protrusion 116 thereby also executes movement of the valve seat element 82 and moves away from the sealing ring 118, by which means the second valve 68 is inevitably opened, which leads to aeration of the outlet 52. If water now flows in the flow direction S to the safeguard 36 again, the first valve 66 is displaced back into the operating position shown in FIG. 5 again by displacement of the valve seat element 82 in the direction of the arrow S, by which means the second valve 68 is inevitably closed again. It should be noted that, in this embodiment, the valve seat element 82 is guided solely by the sealing member 100 in the shape of a rolled diaphragm and, in the backflow position 82*a*, an impermissible swiveling-out of the valve seat element 82 is prevented by the lug 110 surrounded with clearance by the flank 118''.

Figure 7:
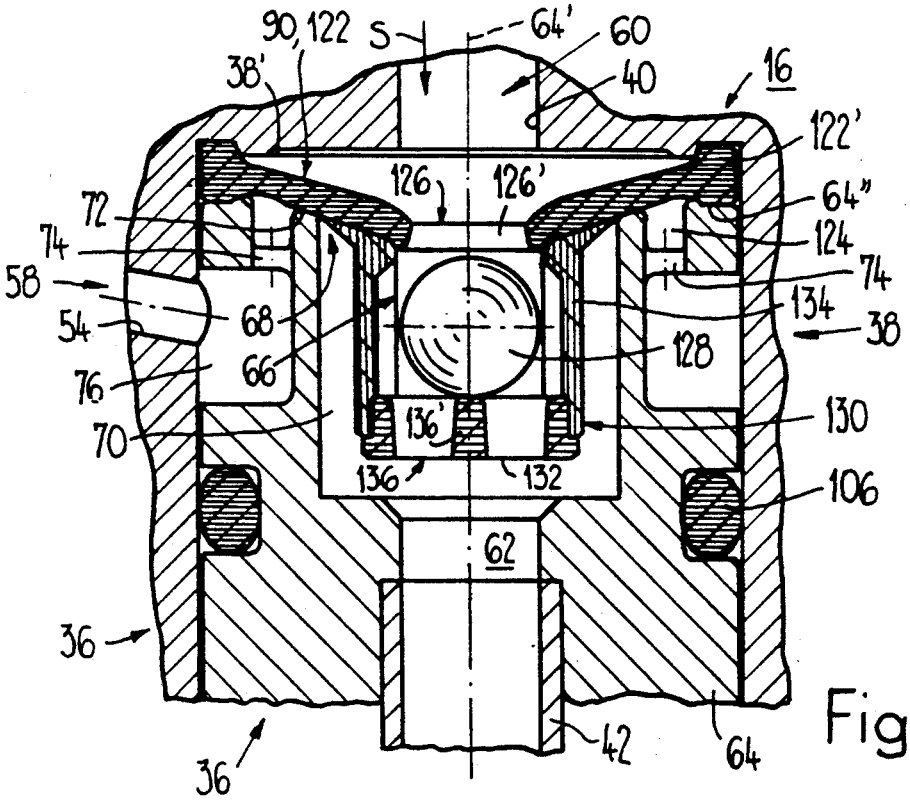
FIG. 7 show a third embodiment of a safeguard under normal conditions.
Figure 8:
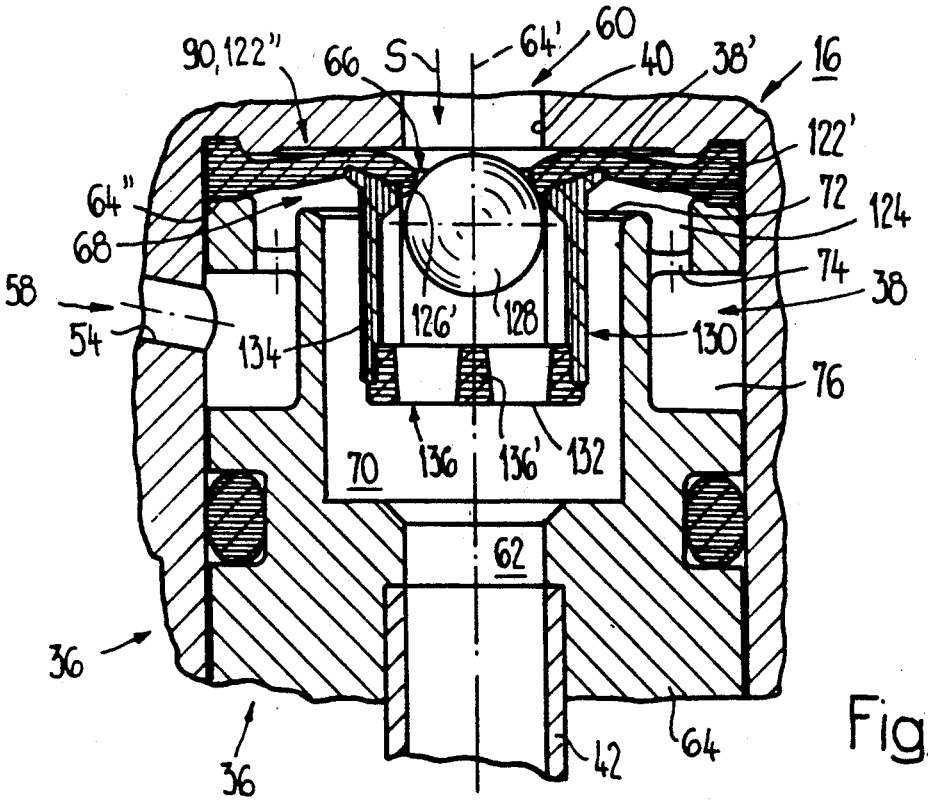
FIG. 8 shows the embodiment according to FIG. 7 under conditions allowing backflow.

A third development of the safeguard 36 is shown in FIGS. 7 and 8. The essentially cylindrical housing 64 of the safeguard 36 is inserted in a known manner in the additional recess 38, which is open toward the bottom, in the upper housing part 16. The cylindrical housing recess 70 which extends in the direction of the axis 64' of the housing 64 and has the shape of a blind hole, opens out at its lower end into the outlet opening 6 which is in communication with pipe 42 which is inserted with this end in the housing 64. Arranged between the upper end 38' of the additional recess 38 and the upper end 64'' of the housing 64 is the valve body 90 of the second valve 68 constructed in the form of a rubber-elastic diaphragm 122. Said diaphragm is constructed so as to be thicker at its circumferential region 122' and is held in this region braced between the upper end 38' of the recess 38 and the housing 64. The diaphragm 122 interacts with an annular valve seat 72 which is provided, as seen in the flow direction S, below the diaphragm 122 and is bounded in the radial direction on the inside by the housing recess 70 and on the outside by an aeration groove 124 which runs around the valve seat 72 and is open in the direction toward the diaphragm 122. The aeration groove 124 is connected via aeration passages 74 extending parallel to the axis 64' to a circumferential groove 76 constructed below the aeration groove 124 on the housing 64, which circumferential groove is in communication with the ambient air via the aeration channel 54 in the upper housing part 16 (cf. FIG. 1).

In the central region, the diaphragm 122 has an annular water passage 126, the edge 126' of which, as the valve seat of the first valve 66, interacts with a ball 128 forming the valve body 88. Following the water passage 126 as seen in the flow direction S, the ball 128 is held so as to be freely movable with a clearance in a tubular holding device 130 so that the ball 128, as seen in the flow direction S, can be lifted from the edge 126' and the water can flow around the ball 128 to the exit 132 situated downstream. The holding device 130 made of plastic has an essentially hollow-cylindrical sleeve 134 which is attached, for example by bonding or vulcanizing, to the membrane 122 by its end facing said membrane 122. An annular end section 136 having a web 136' extending in the direction of the diameter is inserted and fastened in the sleeve 134 in the end region remote from the diaphragm 122, which web prevents the ball 128 from escaping in the flow direction S from the sleeve 134.

Provided below the circumferential groove 76 is an O-ring 106 which is positioned in a corresponding groove in the housing 64 and bears against the upper housing part 116 on the circumferential side. The circumferential groove 76 is sealed off by the thickening 122' of the diaphragm 122 and this O-ring 106 at the top and bottom as seen in the direction of the axis 64. In FIG. 7, the diaphragm 122 is in the operating position which it assumes under normal operating conditions and in which the second valve 68 is closed. In this case, the diaphragm 122 bears against the valve seat 72.

FIG. 8 illustrates the safeguard 36 shown in FIG. 7, the diaphragm 122 being shown as it is deformed into the backflow position 122'' by the opening of the second valve 68. All the parts of FIG. 8 correspond to the parts of FIG. 7. Therefore, reference numerals are only inserted in FIG. 8 insofar as this is necessary for understanding the figure. In the backflow position 122'', the diaphragm 122 bears with its region opposite the sleeve 134 against the upper end 38' of the recess 38, by which means the backflow position 122'' is precisely determined and excessive deformation of the diaphragm 122 is prevented. In this position, the diaphragm 122 is lifted from the valve seat 72 and connects the aeration path 58 communicated with the ambient air through the aeration channel 54, the circumferential groove 76, the aeration passages 74 and aeration groove 124 to the part of the flow path 60 following the first valve 66, as seen in the flow direction S. In this case, it should be noted that the ball 128 bears against the edge 126' and the first valve 66 is consequently closed.

The safeguard 36 shown in FIGS. 7 and 8 operates as follows: under normal operating conditions, the diaphragm 122 forming the valve body 90 of the second valve 68 bears against the annular valve seat 72. The second valve 68 is closed (FIG. 7) In this case, the first valve 66 is in the open position since, when the water flow is stopped as a result of the dead weight and in the case of water flowing in the flow direction S additionally due to the force exerted by the water, the ball 128 bears against the cover 136. When the control cartridge 32 is opened (FIG. 1), the water can consequently flow along the flow path 60 from the feedline 34 through the first valve 66 of the safeguard 36 to the outlet 52. Even in the case of very rapid interruption of the water flow due to closure of the control cartridge 32, the second valve 68 is not opened since, in this case, the diaphragm 122 is pulled downward in the flow direction S.

If, in contrast, the rare case of a negative pressure occurs on the feed side in relation to the first valve 66, the ball 128 is brought to rest on the edge 126' by the water attempting to flow back counter to the flow direction S, by which means the first valve 66 is closed automatically. The pressure difference between the two sides of the diaphragm 122 now results in the latter being deformed into the backflow position 122" shown in FIG. 8 as a result of the suction at the input side. In this case, the second valve 68 is inevitably opened, exposing a gap between the diaphragm 122 and the valve seat 72, by which means the outlet 52 is connected to the ambient air and aerated.

During deformation of the diaphragm 122 from the operating position into the backflow position 122", said diaphragm passes through an unstable position and, after passing through this position, is held in a stable manner in the backflow position 122" due to its inherent elasticity, bearing against the upper end 38' of the recess 38 until the diaphragm 122 again snaps back into the operating position upon later impacting with water fed in the flow direction S. In this case, the backflow position 122" is selected such that small forces in the direction of the arrow S are quite sufficient to deform the diaphragm 122 back into the operating position.

Of course, it is also conceivable to arrange the valve seat for the ball 128 in the holding device 130.

Figures 9, 10, 11:
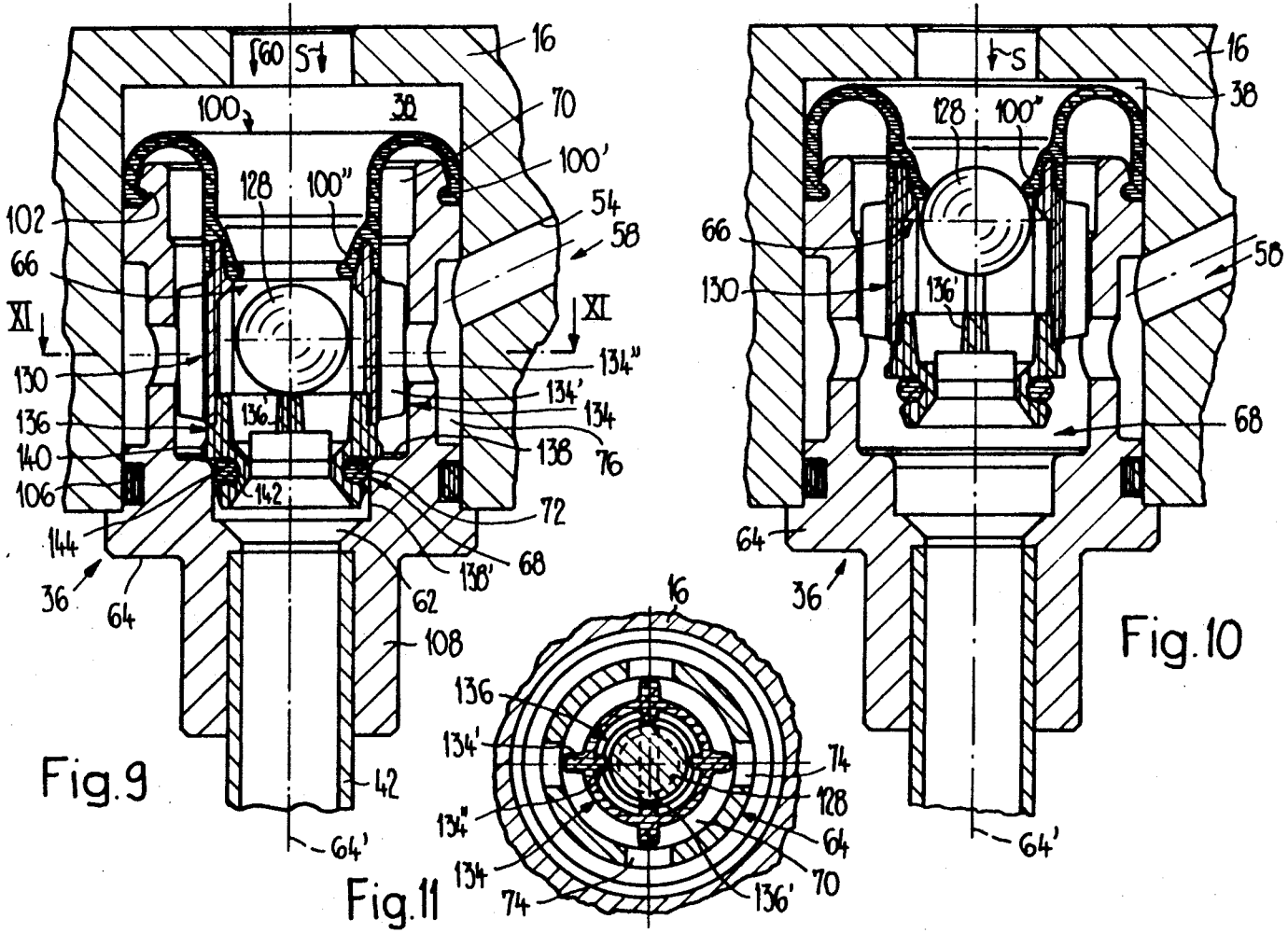
FIG. 9 shows a fourth embodiment of the safeguard under normal operating conditions.
FIG. 10 shows the embodiment of FIG. 9 under conditions allowing backflow.
FIG. 11 shows a horizontal section taken along line XI—XI of FIG. 9.

FIGS. 9 to 11 show a further development of the safeguard 36 which is very similar to the safeguard shown 10 in FIGS. 5 and 6, the first valve 66 being formed by a ball check valve. FIGS. 9 and 10 show the safeguard 36 under normal operating conditions and under operating conditions allowing backflow, respectively, and FIG. 11 shows a horizontal section along the line XI—XI of FIG. 9. Firstly the safeguard 36 is described with reference to FIG. 9

The essentially cylindrical housing 64 of the safeguard 36 is inserted and held in a known manner in the additional recess 38, which is open downward, in the 20 upper housing part 16. The essentially cylindrical housing recess 70 extending in the direction of the axis 64' of the housing 64 has in its lower end region a steptype taper 138, the cylindrical wall 138', following the taper 138 as seen in the flow direction S, forming the valve 25 seat 72 of the second valve 68. The housing recess 70 opens out into the conically tapering outlet aperture 62 which is connected in terms of flow to the pipe 42 inserted with its end region in the connection nozzle 108. The annular, cross-sectionally U-shaped sealing 30 member 100 in the shape of a rolled diaphragm made of rubber-elastic material (cf. also FIGS. 2 to 4) is held by its outer end region at the upper end region of the housing 64 by engaging with a protrusion 100, in a circumferential groove 102 of the housing 64 and being held there clamped between the housing 64 and the upper housing part 16. In its inner end region engaging in the recess 70, the sealing member 100 is of a cross-sectionally fork-shaped construction, the inner lip 100" forming with its end of a thickened construction the valve seat of the first valve 66. The valve body interacting with this valve seat is formed by the ball 128 (cf. also FIGS. 7 and 8) which is arranged in the interior of the tubular holding device 130. The sleeve 134 of the holding device 130 engages with its upper end region in the forked sealing member 100 and is attached to the latter. The sleeve 134 has four wings 134' projecting outward in the radial direction in order to support the holding device 130 on the housing 64 so as to be readily displaceable in the direction of the axis 64'. For this purpose, the distance between the outer ends, as seen in the radial direction, of the diametrically opposite wings 134' are slightly smaller than the free diameter of the housing recess 70. Additionally, inside wings 134", projecting inward and likewise extending in the axial direction, are molded onto the sleeve 134 in order to mount the ball 128 so as to be readily displaceable in the direction of the axis 64'. An essentially hollow-cylindrical end section 136 is inserted from below in the sleeve 134 and preferably held by means of a snap-on connection. The end section 136 has a web 136' which penetrates said end section in the manner of a spoke. Consequently, the ball 128 can be displaced back and forth between the lip 100" and the web 136' in and counter to the flow direction S. Molded onto the end section 136 below the sleeve 134 is a circumferential protrusion 140 which is supported on the taper 138 counter to the flow direction S when the first valve 66 is in the operating position (FIG. 9). Below the circumferential protrusion 140, the end section 136 has a circumferential groove 142 in which there is placed an O-ring 144 interacting with the wall 138'. Consequently, the holding device 130 forms the valve body of the second valve 68. Consequently, the holding device 130 has exactly the same functioning as the valve seat element 82 in the embodiment shown in FIGS. 5 and 6.

The annular space between the housing 64 and the holding device 130, which is bounded at the top by the sealing member 100, is connected by means of four aeration passages 74 penetrating the housing 64 in the radial direction to the circumferential groove 76 which, in turn, is in flow connection with the aeration channel 54. The circumferential groove 76 is sealed off at the top by the protrusion 100' of the sealing member 100 and at the bottom b an O-ring 106.

FIG. 10 shows the safeguard 3 under conditions allowing backflow. As a result of the pressure drop present counter to the flow direction S, the ball 128 is lifted, with the result being that the latter bears against the lip 100" and consequently the first valve 66 is closed. Additionally the holding device 130 is lifted counter to the direction of the arrow S due to the pressure drop, as a result of which the second valve 68 is inevitably opened. The flow path 60 between the outlet 52 and the feedline 34 (FIG. 1) is consequently interrupted by the first valve 66 and the outlet 52 is connected through the aeration path 58 to the environment as a result of the opened second valve 68.

The safeguard 36 illustrated in FIGS. 9 to 11 functions as follows: under normal operating conditions, the first valve 66 is open and the second valve 68 is closed, as shown in FIG. 9. The water fed in the flow direction S flows through the sealing member 100 and the holding device 130 and is subsequently fed through the pipe 42 and the hose 44 to the outlet 52 of the shower 50. In the interior of the sleeve 134, the water flows around the ball 128 which is held by the web 136' counter to the water flow. If the water flow is interrupted by closure of the control cartridge 32 upstream of the safeguard 36, the first valve 66 remains opened. Even in the case of very rapid closure of the control cartridge 32, the negative pressure which is thereby possible in the section of the flow path 60 following the control cartridge 32 cannot open the second valve 68, with the result being that no water can emerge through this valve 68.

If, when the control cartridge 32 is opened, the extremely rare case now occurs that a negative pressure prevails in the feedline 34 the first valve 66 is closed automatically by lifting the ball 128, as shown in FIG. 10. Due to the negative pressure on the feed side, the first valve 66 together with the holding device 130 is then lifted into the backflow as shown in FIG. 10 counter to the direction of the arrow S, which inevitably brings about the opening of the second valve 68. Consequently, under conditions allowing backflow, no water can flow back from the outlet side into the feedline 34 and, moreover, the outlet 52 is connected through the aeration path 58 to the environment. If the negative pressure on the feed side now falls away, the first valve 66 opens by the ball 128 falling back onto the web 136' if fresh water is now fed in again, the holding device 130 automatically moves downward by the flow of the water, which results in an inevitable and immediate closure of the second valve 68.

Figure 13:
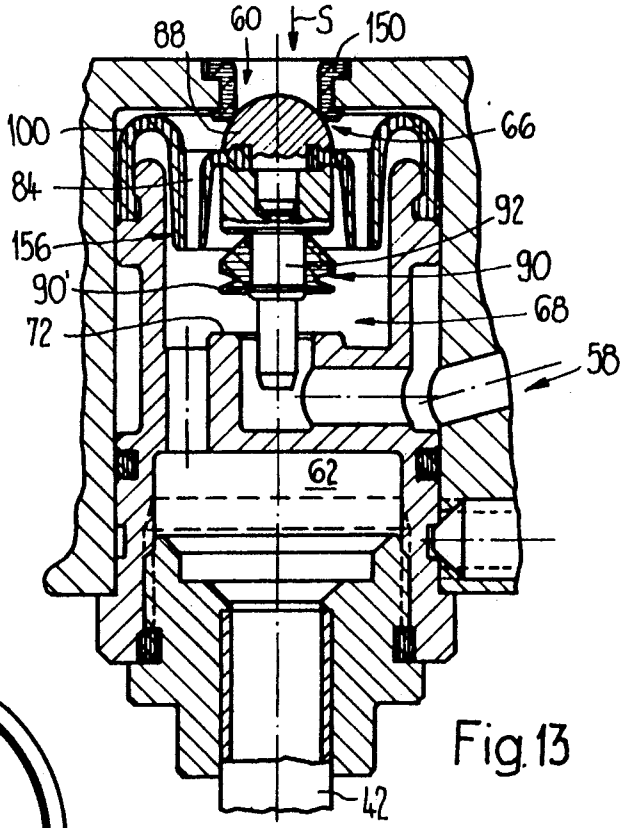
FIG. 13 shows the embodiment according to FIG. 12 under conditions allowing backflow.
Figure 14:
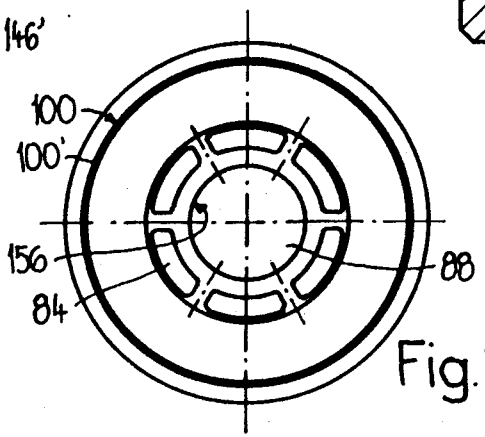
FIG. 14 shows a section taken along line XIV—XIV of FIG. 12.
Figure 12:
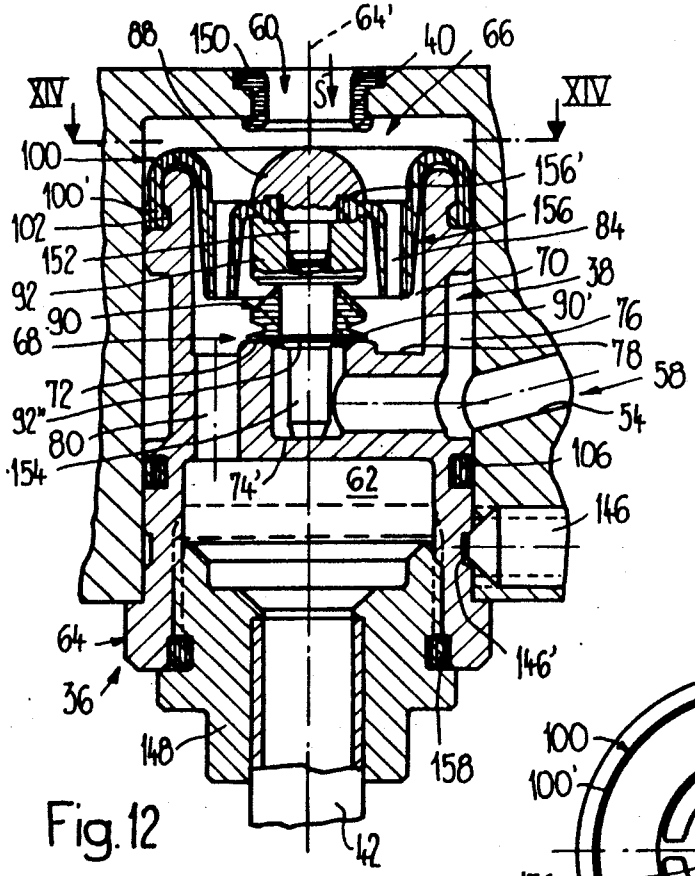
FIG. 12 shows a further embodiment of the safeguard under normal operating conditions.

A further embodiment of the safeguard 36 is illustrated in FIGS. 12 to 14, said embodiment differing essentially from the embodiments described above in that the valve seat of the first valve 66 is arranged in a stationary manner and the valve body 88 of the first valve 66 is coupled to the valve body 90 of the second valve 68. FIG. 12 shows the safeguard 36 under normal operating conditions, whereas in FIG. 13 the safeguard 36 is illustrated under conditions allowing backflow. FIG. 14 shows a section along the line XIV—XIV of FIG. 12.

The safeguard 36 is inserted from below in the recess 38 of the upper housing part 16 and is held there by means of a retaining screw 146 which is screwed into the upper housing part 16 in the radial direction in relation to the axis 64' and penetrates said upper housing part. The retaining screw 146 is of a conical construction at its end facing the safeguard 36 and it engages in a circumferential retaining groove 146' in the housing 64 of the safeguard 36. The water fed in through the feedline 34 (FIG. 1) flows from the control cartridge 32 through the passage aperture 40 in the flow direction S through the safeguard 36 to the pipe 42 which is introduced from below into a connection nozzle 148 screwed into the housing 64. The aeration channel 54 leads away from the central region of the additional recess 38 obliquely upward through the upper housing part 16 to the nozzle 48 (cf. FIG. 1).

The safeguard 36 has two valves 66, 68, the first valve 66 being connected in the flow path 60 leading through the safeguard 36 and the second valve 68 being connected in the aeration path 58 connecting the flow path 60 to the ambient air. The second valve 68 is provided in the flow path 60 at the entry o the aeration path 58 and is mounted downstream of the first valve 66, in the flow direction S.

The housing 64 has an essentially cylindrical housing recess 70 which is open toward the passage aperture 40 and has the form of a blind hole, in the base region of which there is constructed an annular valve seat 72 for the second valve 68. The valve seat 72 borders and bounds an aeration passage 74 which extends away from the housing recess 70 downward firstly in the direction of the axis 64' and then in the radial direction to a circumferential groove 76 provided on the housing 64, which circumferential groove is connected in terms of flow to the aeration channel 54. Extending around the valve seat 7 there is a groove-shaped indentation 78, from which bore holes 80 begin extending in the direction of the axis 64', which bore holes connect the housing recess 70 to the outlet opening 62. The outlet aperture 62 is bounded at the bottom by the connection nozzle 148.

An annular valve seat element 150, made of plastic, of the first valve 66 is inserted and held in a snap-on manner in the passage aperture 40. This valve seat element 150 interacts with a hemispherical valve body 88 which has a retaining bolt 152 projecting downward. The retaining bolt 152 is pressed into a hole in a shaft 92 which extends in the direction of the axis 64'. Seated on the shaft 92 is an annular valve body 90 of the second valve 68 which is made of rubber-elastic material and has a lip 90' interacting with the valve seat 72. At its upper end, the annular valve body 90 is in contact with a step-type taper of the shaft 92 and is held at the bottom by a holding rib 92'' molded onto the shaft. Consequently, the valve body 90 is seated fixedly against displacement on the shaft 92. The lower part 154 of the shaft 92 projecting over the valve body 90 in the direction of the axis 64' engages in the aeration passage 74 and is supported on the base 74' of the aeration passage 74 when the valve body 88 is in the operating position. When the second valve 68 is closed, the position of the valve body 90 in relation to the valve seat 72 interacting with it is thereby precisely defined.

Provided in the recess 70 in the region between the housing 64 and the shaft 92 is a flow element 156 which surrounds the shaft 92 in a annular fashion essentially in the region between the valve body 88 and the valve body 90, as is also shown in FIG. 14. This flow element 156 is formed from rubber-elastic material and has a plurality of flow apertures 84 extending in the direction of the axis 64'. Molded onto the flow element 156 at its inner upper end is a collar 156' which projects inwardly in the radial direction and is constructed so as to be thickened at its free end. The collar 156' engages between the valve body 88 and the shaft 92 and it is held on the latter by means of reliefs. Molded onto the flow element 156 in on piece outside the flow apertures 84 is a cross-sectionally U-shaped sealing member 100 in the shape of a rolled diaphragm which surrounds the upper end region of the housing 64 and is held clamped between the housing 64 and the upper housing part 16 by means of a protrusion 100' engaging in a circumferential groove 102 in the housing 64.

Provided below the circumferential groove 76 is an O-ring 106 which bears against the upper housing part 16 and is arranged in a corresponding groove in the housing 64 of the safeguard 36. Consequently, the circumferential groove 76 is sealed off at the top by the protrusion 100' of the sealing member 100 and at the bottom by the O-ring 106. A further O-ring 158, which acts between the housing 64 and the connection nozzle 148 screwed into said housing, seals off the outlet aperture 62 towards the outside.

The mode of functioning of this embodiment of the safeguard 36 will now described in greater detail with reference to FIGS. 12 and 13. FIG. 13 shows exactly the sam safeguard 36 as FIG. 12, the first valve 66 having closed, however, under conditions allowing backflow and the second valve 68 having opened. In FIG. 13, the reference numerals are only included insofar as they are necessary for understanding the mode of functioning. Under normal operating conditions, the valve body 88 of the first valve 66 and the valve body 90 of the second valve 68 are in the operating position shown in FIG. 12. In this case, the first valve 66 is opened and the lip 90, of the second valve body 90 bears against the valve seat 72. The water fed in the flow direction S flows through the flow apertures 84 in the flow element 156 to the bore holes 80 and through the latter into the outlet aperture 62, from where the water is conducted through the pipe 42 to the hose 44 and the shower 50. If the control cartridge 32 upstream of the safeguard 36 is closed (FIG. 1), the valve bodies 88, 90 remain in the operating position, which results in second valve 68 remaining closed. This occurs even in the case of rapid switching-off of the water flow due to closure of the control cartridge 32. By this means, the emergence of water through the aeration path 58 is prevented in any case. If the extremely rare case then occurs that a negative pressure is built up on the feed side when the control cartridge 32 is opened, the first valve 66 closes automatically by the valve body 88 being lifted under the application of pressure, which is different on the two sides, to the flow element 56 and the sealing member 100, and it is pressed against the valve seat element 150. By this means the flow path 60 is interrupted. Water is thus prevented from flowing back from the outlet 52 to the feedline 34. The position of the valve body 88 is shown in FIG. 13 with valve 66 closed. Since the valve body 88 of the first valve 66 is rigidly coupled by means of the shaft 92 to the valve body 90 of the second valve, the second valve 68 is inevitably opened by the closure of the first valve 66. By this means, the outlet 52 is connected through the aeration path 58 to the environment.

If water is now fed from the feedline 34 to the safeguard 36 again, the flow element 156 together with the two valve bodies 88 and 90 move downward into the operating position, by which means the first valve 66 is opened again and the second valve 68 is inevitably closed.

In all the developments of the safeguard shown, the first valve can be constructed as a check valve of any design. In the developments in accordance with FIGS. 2–11, the essence of the invention consists in the fact that, by virtue of the flow conditions in the flow path under conditions allowing backflow, the first valve can be brought from an operating position assumed under normal operating conditions into a backflow position and the valve body of the second valve also executes this movement in order to be inevitably opened. In the development in accordance with FIGS. 12–14, the first valve is closed automatically under conditions allowing backflow. The closing movement of the corresponding valve body inevitably opens the second valve.

Obviously, numerous modifications and variations of the present invention are possible in light of the above teachings. It is therefore to be understood that within the scope of the appended claims, the invention may be practiced otherwise than as specifically described herein.

What is claimed and desired to be secured by Letters patent of the United States is:

1. A safeguard for a sanitary fitting for preventing the backflow of water into a feedline of the fitting, which comprises:

a shut-off valve connected in a flow path for conducting the water from the feedline to an outlet;

an aeration path connecting the outlet to ambient air;

a first and second valve, at least the latter of which is connected in the aeration path, is closed under normal operating conditions and is opened under conditions allowing backflow for aerating the outlet, wherein the first valve is connected in the flow path, and is mounted, as viewed in the flow direction of the water, upstream of the aeration path and downstream of the shut-off valve, closes automatically under conditions allowing backflow and, after closing, is automatically movable from an operating position assumed under normal operating conditions into a backflow position, movement of said first valve into the backflow position resulting in actuation of the second valve and wherein the first valve comprises a first valve seat element which has a passage for flow of the water and is movable essentially in and counter to the flow direction and on which a first valve seat interacting with a valve body of the first valve is positioned;

said first valve seat element, under normal operating conditions, being charged by throughflowing water in a direction towards the operating position and, under conditions allowing backflow, being movable into the backflow position due to the pressure difference between a side facing the feedline and a side facing the outlet;

said first valve seat element being positioned in a recess of a first housing wherein a sealing member is provided between the first housing and the first valve seat element for preventing the throughflow of water;

said second valve having a valve seat provided on the first housing and being in substantial alignment with the latter, and having a valve body attached to the first valve seat element wherein said first housing has a stop member and said first valve seat element under said normal operating conditions is supported by said stop member of said first housing at a position located outside the valve seat of said second valve; and guiding means for guiding said first valve seat element in a sliding manner on said first housing and for being supported on the latter by means of said stop member.

2. The safeguard as claimed in claim 1, wherein the valve body of the first valve is prestressed in a direction towards the corresponding valve seat and is liftable from the latter by the flowing water.

3. The safeguard as claimed in claim 1, wherein both the first and second valves are arranged in a common housing which is inserted in a recess of a housing of the sanitary fitting.

4. A safeguard for a sanitary fitting for preventing the backflow of water into a feedline of the fitting, which comprises:

a shut-off valve connected in a flow path for conducting the water from the feedline to an outlet;

an aeration path connecting the outlet to ambient air;

a first and second valve, at least the latter of which is connected in the aeration path, is closed under normal operating conditions and is opened under conditions allowing backflow for aerating the outlet, wherein the first valve is connected in the flow path, and is mounted, as viewed in the flow direction of the water, upstream of the aeration path and downstream of the shut-off valve, closes automatically under conditions allowing backflow and, after closing, is automatically movable from an operating position assumed under normal operating conditions into a backflow position, movement of said first valve into the backflow position resulting in actuation of the second valve and wherein the first valve comprises a first valve seat element which has a passage for flow of the water and is movable essentially in and counter to the flow direction and on which a first valve seat interacting with a valve body of the first valve is positioned;

said first valve seat element, under normal operating conditions, being charged by throughflowing water in a direction towards the operating position and, under conditions allowing backflow, being movable into the backflow position due to the pressure difference between a side facing the feedline and a side facing the outlet;

said first valve seat element being positioned in a recess of a first housing wherein a sealing member is provided between the first housing and the first valve seat element for preventing the throughflow of water;

said second valve having a valve seat provided on the first housing and being in substantial alignment with the latter, and having a valve body attached to the first valve seat element; and guiding means for guiding said first valve seat element in a sliding manner on said first housing and for being supported on the latter by means of said stop member wherein the sealing member comprises a rolled diaphragm which engages the first housing on one side and the valve seat element on the other side.

5. A safeguard for a sanitary fitting for preventing the backflow of water into a feedline of the fitting, which comprises:

a shut-off valve connected in a flow path for conducting the water from the feedline to an outlet;

an aeration path connecting the outlet to ambient air;

a first and second valve, at least the latter of which is connected in the aeration path, is closed under normal operating conditions and is opened under conditions allowing backflow for aerating the outlet, wherein the first valve is connected in the flow path, and is mounted, as viewed in the flow direction of the water, upstream of the aeration path and downstream of the shut-off valve, closes automatically under conditions allowing backflow and, after closing, is automatically movable from an operating position assumed under normal operating conditions into a backflow position, movement of said first valve into the backflow position resulting in actuation of the second valve and wherein the first valve comprises a first valve seat element which has a passage for flow of the water and is movable essentially in and counter to the flow direction and on which a first valve seat interacting with a valve body of the first valve is positioned;

said first valve seat element, under normal operating conditions, being charged by throughflowing water in a direction towards the operating position and, under conditions allowing backflow, being movable into the backflow position due to the pressure difference between a side facing the feedline and a side facing the outlet;

said first valve seat element being positioned in a recess of a first housing wherein a sealing member is provided between the first housing and the first valve seat element for preventing the throughflow of water;

said second valve having a valve seat provided on the first housing and being in substantial alignment with the latter, and having a valve body attached to the first valve seat element;

guiding means for guiding said first valve seat element in a sliding manner on said first housing and for being supported on the latter by means of said stop member wherein said passage comprises a plurality of flow passages and wherein said valve seat element has an upwardly directed bell shaped indentation within which the valve bodies of said first and second valves are disposed.

6. The safeguard as claimed in claim 5, wherein said valve body of the first valve is of a bell shaped form and bears with a lower end region thereof against said valve seat element and wherein a shaft interconnects said valve body and said valve seat element.

7. The safeguard as claimed in claim 6, which comprises a perforated disk which is connected by said shaft to said valve seat element.

* * * * *